US005131656A

United States Patent [19]

Kinoshita

[11] Patent Number: 5,131,656

[45] Date of Patent: Jul. 21, 1992

[54] IMPULSE PERFORMANCE PUTTER

[76] Inventor: Frank Kinoshita, P.O. Box 3164, Rancho Santa Fe, Calif. 92067

[21] Appl. No.: 760,518

[22] Filed: Sep. 16, 1991

[51] Int. Cl.[5] ..... A63B 53/04

[52] U.S. Cl. ..... 273/164; 273/167 J; 273/169; 273/80 C; 273/80 A; 273/167 F

[58] Field of Search ..... 273/167-175, 273/164, 77 A, 77 R, 193 R, 194 R, 194 B, 78, 79, 183 D, 186 A, 80 A, 80 C; D21/217-220

[56] References Cited

U.S. PATENT DOCUMENTS

| | | | |
|---|---|---|---|
| D. 239,402 | 3/1976 | Kindred | 273/167 G X |
| 1,133,129 | 3/1915 | Govan | 273/171 |
| 3,085,804 | 4/1963 | Pieper | 273/168 |
| 3,332,684 | 7/1967 | Solheim | 273/81.3 |
| 3,448,981 | 6/1969 | Anweiler | 273/80 |
| 3,625,517 | 12/1971 | Durnack | 273/167 F |
| 3,652,093 | 3/1972 | Reuter | 273/169 |
| 3,873,094 | 3/1975 | Sebo et al. | 273/163 R |
| 3,954,265 | 5/1976 | Taylor | 273/80 C |
| 3,955,820 | 5/1976 | Cochran et al. | 273/169 X |
| 4,010,958 | 3/1977 | Long | 273/169 |
| 4,063,733 | 12/1977 | Benedict | 273/167 G X |
| 4,136,877 | 1/1979 | Antonious | 273/164 |
| 4,199,144 | 4/1980 | Skelly | 273/164 |
| 4,240,636 | 12/1980 | Swenson | 273/169 |
| 4,325,550 | 4/1982 | Thompson | 273/80 C |
| 4,325,553 | 4/1982 | Taylor | 273/167 F |
| 4,390,184 | 6/1983 | Rudell | 273/183 D |
| 4,411,429 | 10/1983 | Drew | 273/164 |
| 4,411,430 | 10/1983 | Dian | 273/171 |
| 4,508,342 | 4/1985 | Drake | 273/80 C |
| 4,508,350 | 4/1985 | Duclos | 273/183 D |
| 4,527,799 | 7/1985 | Solheim | 273/164 |
| 4,650,191 | 3/1987 | Mills | 273/164 |
| 4,693,478 | 9/1987 | Long | 273/164 |
| 4,832,344 | 5/1989 | Werner | 273/174 X |
| 4,852,879 | 8/1989 | Collins | 273/164 |
| 4,913,438 | 4/1990 | Anderson | 273/164 |
| 4,966,369 | 10/1990 | Griffin | 273/80 A |

FOREIGN PATENT DOCUMENTS

| | | | |
|---|---|---|---|
| 2217611 | 11/1989 | United Kingdom | 273/167 H |

OTHER PUBLICATIONS

"Golf Digest" Magazine, Apr. 1977 issue, p. 34.

*Primary Examiner*—William H. Grieb
*Assistant Examiner*—Sebastiano Passaniti

[57] ABSTRACT

This invention relates to a category of golf equipment known as a putter. The putter head of the present invention defines a ball striking front face, a bottom surface, a top surface, a rear surface, a heel, a toe; and a hosel integrally attached to the top surface, the hosel being that portion of the putter head that is designed to interface with a putter shaft. A view of the rear surface shows three substantial mass sections. One mass section is located directly behind the golf ball impact point and the other two mass sections are used for the heel-toe weighting of the putter head. Two high moment of inertia structures are used to rigidly connect the mass section located directly behind the impact point to the heel-toe weighting mass sections. Said high moment of inertia structures ensure that maximum momentum transfer to the golf ball is realized from the momentum of the heel-toe mass sections at impact.

16 Claims, 5 Drawing Sheets

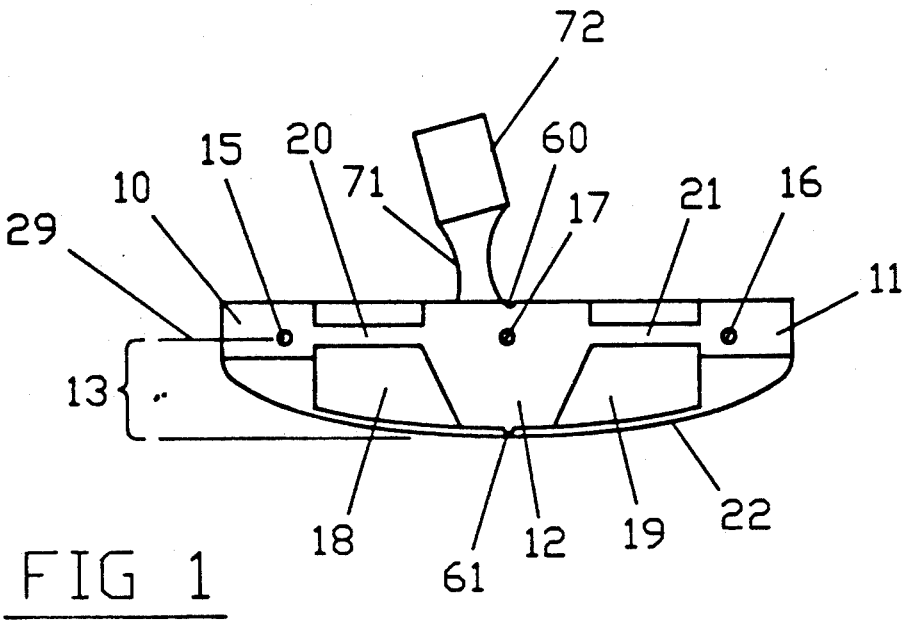
FIG 1
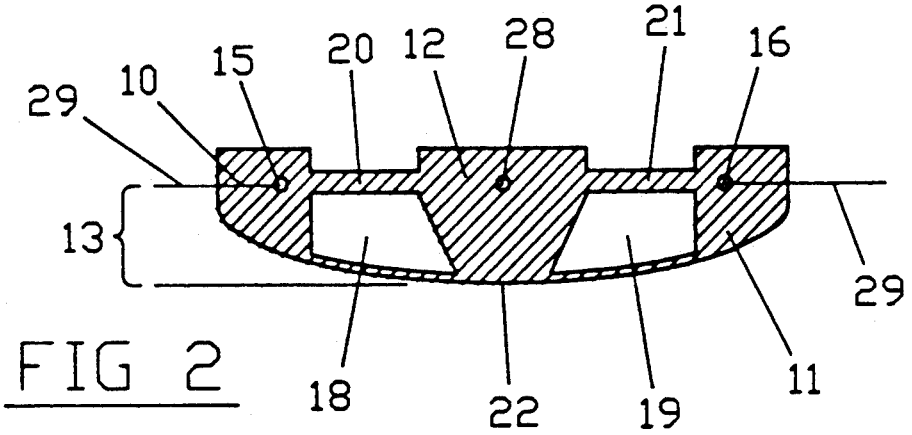
FIG 2
FIG 2B
PRIOR ART
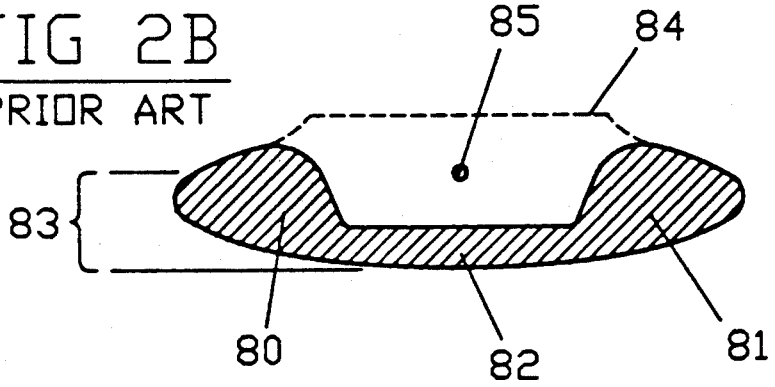

FIG 3
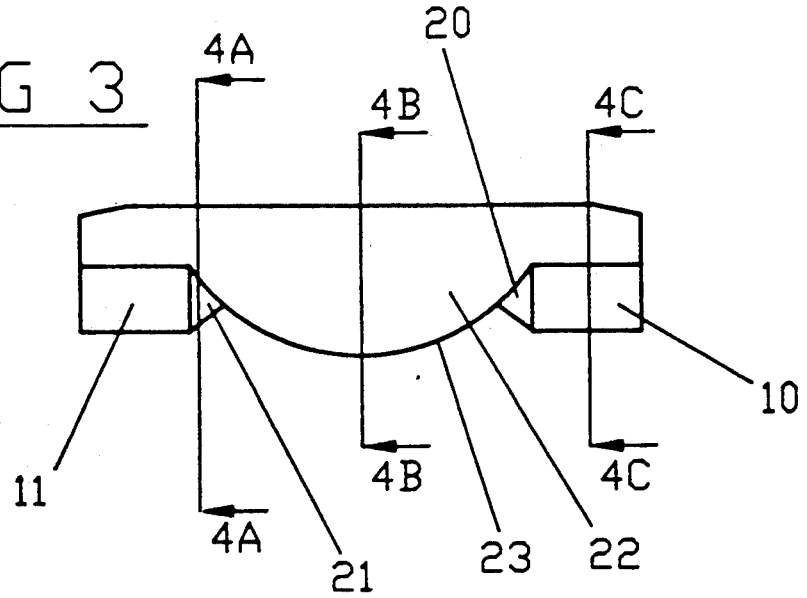
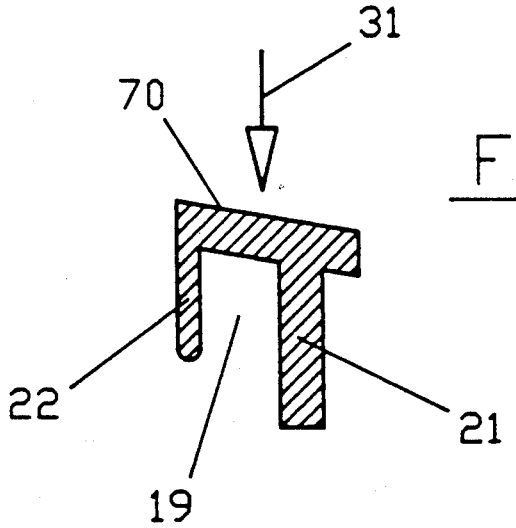
FIG 4A
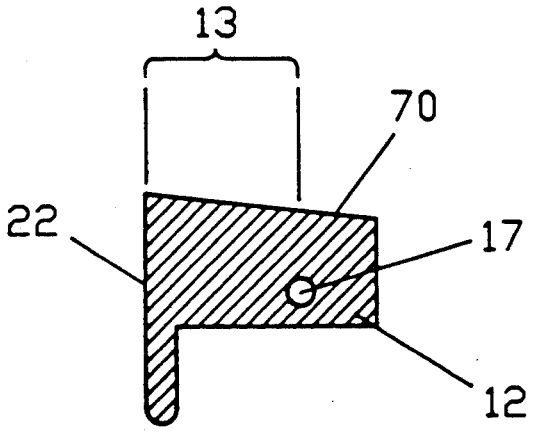
FIG 4B
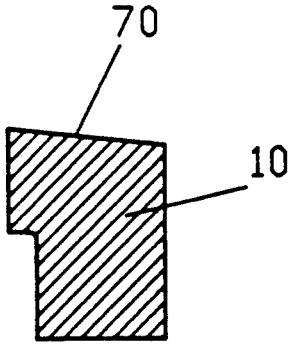
FIG 4C

IMPULSE PERFORMANCE PUTTER

BACKGROUND OF THE INVENTION

The present invention relates to a particular category of golf equipment known as a putter. There is clearly continuing need for improvement in the playability of golf equipment, particularly with respect to the putter. As well known to those who know the game of golf, putting often accounts for nearly half of a golfer's total score during the course of a round. Although, most golfers carry a single putter with them during the course of a round, the golfer is not prohibited from carrying two, or more than two putters. However, the golfer is limited to fourteen clubs. It is the intent of the present invention to include a broad range of putter configurations that could possibly make it advantageous for the golfer to carry one, or more than one putter. The end goal is to reduce the number of strokes taken by the golfer to complete a round of golf. Toward this end, the putter constraints are broad as far as the putter head material, weight, loft and lie angles are concerned.

OBJECT OF THE INVENTION

Provide an impulse performance putter with superior playing characteristics compared to prior art putters. Superior playing characteristics of the present invention's putter are obtained by employing the features discussed herein:

(A) To provide a putter head configuration that has an unique mass section located directly behind the impact point. This unique mass section located directly behind the impact point is defined as the impact point mass section. The impact point mass section and the unique high moment of inertia connections to the heel-toe weighing mass sections provides superior momentum transfer to the golf ball compared to prior art putter heads. Prior art heel-toe weighted high radius of gyration putter heads are devoid of any meaningful mass section located directly behind the impact point. Prior art seems to imply that the heel-toe mass momentum transfer to the point of impact will occur through the sole flange and/or through the thin striking face plate. Specifically, U.S. Pat. Nos. 4,693,478 and 4,852,879 do not describe or claim any mass section located directly behind the impact point. I am not aware of any prior art, either in patents or the marketplace, where a heel-toe weighted putter head configuration utilizes a substantial mass section located directly behind the impact point. Generally, in the prior art heel-toe-sole weighted putters, the putter head center of gravity is located in free space and is not located within the putter head itself. The putter head center of gravity of the present invention is located within the impact point mass section. The impact point mass section aids the attainment of a truly rigid body putter head that affords superior momentum transfer to the golf ball compared to prior art putters.

(B) To provide an unique heel-toe weighted putter head configuration that affords a high radius of gyration. Said high radius of gyration will reduce the adverse effects of directional loss and momentum transfer loss caused by off-centered impacts along the horizontal dimension. Since the present invention's unique heel-toe weighted sections are rigidly attached to the impact point mass section by high moment of inertia structures, a large sweet spot along the horizontal dimension is realized. Unlike prior art, the center of gravity of the present invention's heel-toe mass sections are uniquely located in order to attain a putter head center of gravity location of approximately 0.65 inch above the sole. More importantly, the center of gravity of the heel-toe mass sections are located substantially on the same horizontal plane as the putter head center of gravity. This vertical alignment of the mass sections facilitates the implementation of a rigid connection between the heel-toe mass sections and the impact point mass section.

(C) To provide a high moment of inertia structure that affords a rigid connection between the heel-toe weighted sections and the impact point mass section. The term moment of inertia as applied to these connecting structures could be referred to as the "second moment of area", but since the term moment of inertia is used in beam deflection analysis, the term moment of inertia will be used here. To reduce the weight of the putter head, said connecting structures are thin in the vertical dimension, but are wide in the front to back dimension to obtain high front to back moment of inertia connecting structures. In beam analysis, deflection $= 5\ wl^4/384EI$ for the case where the beam is supported on both ends. E = Modulus of Elasticity. Modulus of Elasticity of brass is approximately 14,000,000 psi and of steel is approximately 29,000,000 psi. I = moment of inertia. It can be seen from the beam deflection equation given above that for a given set of conditions, deflection is inversely proportional to the moment of inertia. With an ideal putt and zero deflection, all of the heel-toe mass momentum will be transferred to the golf ball. Hence, it is very important to have a putter head configuration that affords high moment of inertia connection(s) between the heel-toe mass sections and the impact point mass section.

Also for optimum momentum transfer to the golf ball, the high moment of inertia connecting structure, which is the beam in this analysis will pass through a point directly behind the impact point. U.S. Pat. Nos. 4,693,478 and 4,852,879 do not describe or claim a high moment of inertia heel-toe connecting structure that passes directly behind the impact point. Also, none of the listed Patents described in the accompanying Information Disclosure Statement or the marketplace to my knowledge describes, claims, or has a high moment of inertia heel-toe mass connecting structure(s) that passes directly behind the impact point. In general, it appears that previous heel-toe weighted putter heads use the sole flange and a thin striking plate at the impact point to form the connection of the heel-toe mass sections. The thin striking plate of the prior art does not afford a high front to back moment of inertia connection. In this deflection analysis, the deflection caused by the golf ball impact will be in the front to back direction. It appears that previous putter heads do not have a high moment of inertia heel-toe mass connecting structure that passes directly behind the impact point. Apparently, no putter prior to the disclosure has a high moment of inertia connecting structure to rigidly connect the heel-toe mass sections together and then in turn connect said structure to a point directly behind the impact point. The present invention is superior to previous putter heads by adding the impact point mass section to obtain a rigid putter head. Said rigid putter head is heel-toe weighted and contains substantial real mass at the impact point resulting in a maximum momentum transfer to the golf ball.

A high radius of gyration putter head that does not rigidly connect its heel-toe mass sections to the impact point does not afford an elongated sweet spot along the horizontal dimension. An authority states that: "For golf balls contacted more than ¼ inch from the sweet spot while the other parameters were in perfect order, putts of 8 feet or greater would miss 95 percent of the time." [Dave Pelz in *Putt Like The Pros*, Harper Perennial (1989), p 71]. This statement emphasizes the need for a high radius of gyration putter head that undergoes a negligible amount of deflection at impact. Putter head behavior under an impulse (impact with the golf ball) is a very important consideration neglected by the prior art.

(D) To provide a solid, compact putter head affording a center of gravity that is on a horizontal plane 0.65 inch above the bottom of the sole. Placing the center of gravity at 0.65 inch above the sole, raises the expectation of having said center of gravity located directly behind the impact point at impact. If at impact, the bottom of the putter sole is 0.13 inch above the resting plane of the golf ball and the putter head has a loft angle of 4 degrees, the center of gravity of the putter head will be directly behind the impact point. Of course, this assumes that the putter head is moving horizontally at impact. An authority on putting states that: "Most golfers strike the ball approximately 4/10 inch above the sole of the putter, so if you are among this group, your putter should have its weight evenly distributed above and below this point." [Dave Pelz in *Putt Like The Pros*, pp 169, 170]. This authoritative statement indicates that most golfers have raised the sole of their putters off of the ground by approximately 0.38 inch at impact. This statement seems to be supported by the abundance of low center of gravity sole weighted putters in existence today. If most golfers use these low center of gravity sole weighted putters, the golfers are forced to raise the sole of the putter off of the ground by approximately 0.38 inch in order to get the putter head center of gravity directly behind the point of impact. Since the putter of the present invention has a center of gravity located 0.65 inch above the sole, the golfer only needs to raise his putter sole off of the ground a mere 0.13 inch in order to place the putter head center of gravity directly behind the impact point. The smaller sole height adjustment, 0.13 inch versus 0.38 inch for a typical prior art putter, between the address position and the impact position will most certainly aid the golfer in attaining a smoother putting stroke. Thus, superior playing characteristics are realized with the present invention's putter head center of gravity location.

U.S. Pat. No. 4,693,478 describes a center of gravity height of 0.70 inch above the sole. If said height of 0.70 inch is a design goal, it may be excessively high given that the sole of the putter will only be 0.08 inch above the ground for the maximum available momentum transfer impact. The 0.08 inch requirement may be too stringent since it could lead to occasional scuffing of the green. Moreover, this reference obtains its high center of gravity though use of a bulky aluminum putter head measuring in excess of 5.5×1.3× inches and approximately 1.375 inches in height. U.S. Pat. No. 4,852,879 claims a putter head with a minimum length of 5.208 inches and a minimum height of 1.176 inches and appears to vaguely describe a putter head center of gravity located at approximately the mid-height of his putter. In one embodiment of the present invention, the putter head is a small, compact head measuring approximately 4.25×1.25 inches and approximately 1.0 inch in height wherein its 0.65 inch center of gravity height is obtained through uniquely located mass sections. Said center of gravity height is not obtained by a simple increase of the putter head height dimension or by simply relying on the large mass of the hosel shank to elevate the center of gravity. The use of more mass in the hosel shank to elevate the putter head center of gravity is described in U.S. Pat. No. 4,852,879.

The present invention utilizes a low weight shank and hosel in order to allow maximum concentration of weight in the putter head body. The boring of a hole into the putter head to accommodate a hollow shaft runs counter to the intent of the present invention to provide a solid, compact, and rigid putter head. Of fundamental importance, the momentum of all putter head masses must be transferred to the golf ball under impulse (impact) conditions. This maximum momentum transfer is only possible with a truly rigid body such as the one shown by the present invention.

Regarding the putting stroke, it is not universally recognized that maximum momentum is transferred to the golf ball when the putter head center of gravity is located directly behind the impact point. Note U.S. Pat. No. 4,852,879 page 5 lines 3 through 8 states: "An accompanying advantage, as pointed out above, in aligning the center of mass of the putter head with the center of mass of the golf ball is that maximum driving force or momentum transfer to the golf ball is realized, with minimal diversion of the momentum into a twisting of the club head." In the Description of Preferred Embodiment FIG. 6, this apparent difference in opinion will be discussed further.

(E) To provide a putter head configuration so that the extension of the shaft centerline passes through the putter head center of gravity. This condition is defined as being gravity balanced. The foregoing constraint on the present invention would eliminate any torquing about the shaft axis, caused by the force of gravity. Elimination of the torquing action caused by the force of gravity will aid the golfer in attaining a good putting stroke. U.S. Pat. No. 3,625,517 describes a putter head that appears to be gravity balanced. But this patent claims a blade putter, does not claim heel-toe mass sections to increase the radius of gyration, does not claim a face balanced putter, but claims that the upper portion of the golf ball should be struck with the putter. If the upper portion of the golf ball is to be struck, the putter head must have negative loft angle or the golf ball is to be struck at a downward angle. Neither choice is consistent with the configuration or intended use of the present invention's putter.

(F) To provide a putter head configuration so that when the putter face is facing upwardly, the sum of the moments about the shaft centerline passing through the putter head being zero. This condition is defined as being face balanced. The foregoing constraint of the present invention affords zero torquing of the putter head about the shaft axis during the acceleration of the putter head through the impact zone. U.S. Pat. Nos. 3,954,265 and 4,852,879 appear to describe or claim a face balanced putter. But neither Patent above appears to describe nor claim a gravity balanced putter head.

(G) To provide a low friction highly polished putter face to reduce the gear effect side spin caused by off-centered impacts along the horizontal dimension and side spin caused by off-line swing path impacts. Additionally, gear effect top or back spin caused by improperly located sole height at impact will be reduced because of the highly polished putter face. Gear effect is well discussed in such references as U.S. Pat. Nos. 4,420,156 and 4,471,961. None of the Patents listed on my Information Disclosure Statement describes or claim a highly polished putter face. U.S. Pat. No. 4,852,879 seems to teach away from the desirability of having a highly polished face by stating: "The final grinding operation produces relatively fine (small, shallow) horizontal lines which allow minimum resistance to the ball at contact, thereby providing an immediate rolling action therein at impact." It appears that the importance of having a highly polished putter face has been completely overlooked.

(H) In one embodiment of the present invention, alignment aid indicia are located on the top surface of putter head and on the top surface of putter sole. The two level indicia will facilitate proper alignment of the putter head relative to the golf ball and the intended direction of the putting stroke. All indicia will be downwardly visible from the top of the putter head.

SUMMARY OF THE INVENTION

It is an object of the present invention to provide a golf ball putter comprised of a putter head, a shaft, and a grip; or just a putter head. Said putter head weight range is from 250 to 340 grams. Said putter head is rigidly shaped to define a putter face, a heel, a sole, a toe, a top surface, a hosel, a heel mass section, a toe mass section, an impact point mass section, a high moment of inertia interconnect (or interconnecting structure) joining the heel mass section to the impact point mass section, and a second interconnect (or interconnecting structure) joining the toe mass section to the impact point mass section. Said hosel being integrally attached to said putter head so that the hosel centerline intersects the center of gravity of said putter head. Said heel mass section, said toe mass section, and said impact point mass section are placed so their mass centers are located on a horizontal plane approximately 0.65 inch above said sole. Said interconnect rigidly connects said heel mass section to said impact point mass section, and said second interconnect rigidly connects said heel mass section to said impact point mass section. Said putter head has a center of gravity located substantially halfway between the heel and toe, and on a horizontal plane located approximately 0.65 inch above the sole.

To provide a golf ball putter that affords superior playing characteristics when compared to prior art putters. Superior playing characteristics will be attained because the present invention's putter head is configured to provide impulse performance. In one embodiment of the present invention, the putter head is small, compact, and solid one piece construction. Material used for construction of said putter head may be stainless steel, brass, or any other material of similar densities. The back surface of the putter head is comprised of three distinct uniquely located mass sections. Heel-toe mass sections account for two of the uniquely located mass sections and the impact point mass section accounts for the third. The center of gravity of the three distinct mass sections are located substantially on a horizontal plane 0.65 inch above the sole. Two cavities are formed below said horizontal plane to reduce the weight of the putter head and also to aid in the attainment of the putter head center of gravity.

The three distinct mass sections of the putter head are rigidly connected to each other by high moment of inertia structures (interconnects). The longitudinal axes of said structures are located on a horizontal plane approximately 0.65 inch above the sole. These high moment of inertia structures afford a substantially deflectionless putter head affording impulse performance. The term deflectionless is used to describe the absence of deflection of the putter head in the front to back dimension. Said substantially deflectionless putter head affords an elongated sweet spot along the horizontal dimension. Prior art does not appear to describe or show any concern for the behavior of the putter head deflection at impact. If there is deflection or twisting of the putter head at impact, elongation of the sweet spot may not be realized. Authority states that a ¼ inch deviation from the sweet spot will have dire consequences.

In spite of being small and compact, the putter head of the present invention has a center of gravity located 0.65 inch above the sole because of the distinct location of the heel-toe and impact point mass sections. Constraints on the size and compactness of the putter head aids in the the attainment of a substantially deflectionless putter head. Having a center of gravity located 0.65 inch above the sole allows the golfer to make only a small (0.13 inch) sole height adjustment between the address position and the proper impact position. The 0.13 inch is arithmetically derived from the golf ball impact height of 0.78 inch above the resting plane of the golf ball minus the center of gravity location of 0.65 inch above the sole. Using sole weighted putters which are in vogue today and if the golfer is to properly place the putter center of gravity directly behind the impact point, the golfer must make a large sole height adjustment between his address position and the impact position. Authority states that this height adjustment is in the order of 0.38 inch.

Heel-toe mass sections are utilized to obtain a high radius of gyration. Since in the present invention, said heel-toe mass sections are rigidly connected in a configuration to afford a substantially deflectionless putter head, this feature affords an elongated sweet spot along the putter head horizontal dimension. This feature reduces the adverse directional and loss of force effects caused by off-centered impacts on the horizontal dimension. Authority states that a ¼ inch deviation from the sweet spot will have dire consequences.

Since the putter head of the present invention is gravity balanced, the force of gravity will not cause any torque action about the shaft axis. This putter characteristic allows the golfer to lightly grip the putter shaft without fear of twisting. A putter gripped too tightly can cause severe putting problems.

Since the putter head is face balanced, acceleration through the impact zone will not cause any torque action about the shaft axis. This putter head characteristics also allows the golfer to lightly grip the putter shaft without fear of twisting.

A low friction, highly polished putter face will be utilized to reduce the gear effect side spin caused by off-centered impacts along the horizontal dimension and side spin caused by off-line swing path impacts. Additionally, gear effect top or back spin caused by improperly located sole height at impact will be reduced because of the highly polished putter face.

In one embodiment of this invention, alignment indicia are located on the top surface of the putter head and on the top surface of the sole. These indicia will aid the golfer in attaining proper alignment for his putting stroke.

An impulse performance putter of the present invention is comprised of a shaft, a grip and will provide superior and unique playing characteristics compared to prior art putters due to the features listed as follows:

(a) Substantial mass section being located directly behind the impact point, (b) Heel-toe mass sections that afford high radius of gyration about the vertical axis passing through the putter head center of gravity, (c) Two high moment of inertia structures rigidly connecting the mass section located directly behind the impact point to the heel-toe mass sections, (d) A center of gravity on a horizontal plane approximately 0.65 inch above the bottom surface (also referred to as the sole) of the putter head, (e) The extension of the shaft centerline passing through the putter head center of gravity to afford a gravity balanced putter head, (f) With the putter face facing upwardly, the sum of the moments about the shaft centerline passing through the putter head being zero to afford a face balanced putter head, (g) Highly polished putter face which reduces gear effect side spin caused by off-centered hits along the horizontal dimension, side spin caused by off-line swing path, and top or back spin caused by vertical misalignment of the center of gravity relative to the impact point, and (h) Alignment aid indicia located on the top surface of putter head and on the top surface of putter sole. The unique features of the golf ball putter that are considered characteristic of the present invention are set forth in the appended claims. The invention will readily be understood from the following description when read in connection with the accompanying drawings.

BRIEF DESCRIPTION OF THE DRAWINGS

FIG. 1 is a back surface view of the putter head of the present invention.

FIGS. 2A and 2B are sectional views of the mass sections for a putter head of the present invention and a typical prior art heel-toe-sole weighted putter head.

FIG. 3 is a bottom surface view of the putter head of the present invention.

FIGS. 4A, 4B, and 4C are sectional views of the putter head of the present invention.

DESCRIPTION OF PREFERRED EMBODIMENTS

Figure 5A:
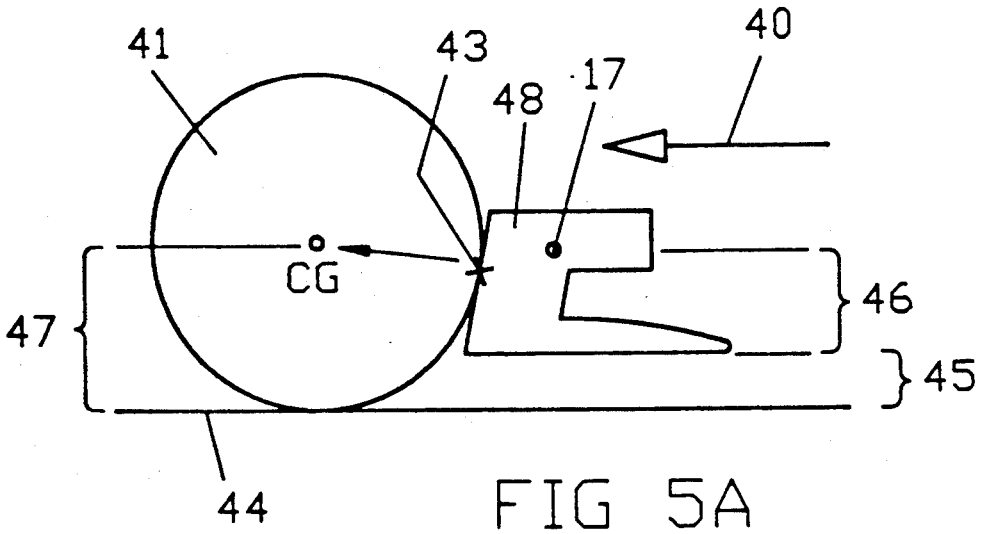
FIGS. 5A and 5B are diagrams that show a putter head body of the present invention and a prior art putter head body striking a golf ball.

Referring to FIG. 1, the back surface of the putter head is comprised of three distinct uniquely located mass sections. Heel-toe mass sections 10, 11 account for two of the uniquely located mass sections and the impact point mass section 12 accounts for the third. The center of gravity 15 and 16 of the heel-to mass sections and the center of gravity 17 of the putter head are located approximately on a horizontal plane 0.65 inch 13 above the sole. Two cavities 18 and 19 are formed below said horizontal plane to reduce the weight of the putter head and also to aid attainment of the putter head center of gravity of 0.65 inch above the sole. The three distinct mass sections are rigidly connected to each other by high moment of inertia structures 20 and 21. The longitudinal axes of said structures are located substantially on said horizontal plane which is 0.65 inch above the sole. These high moment of inertia structures afford a substantially deflectionless putter head. The term deflectionless is used to describe the absence of deflection of the putter head in the front to back dimension at impact. Said substantially deflectionless putter head affords an elongated sweet spot along the putter face horizontal dimension.

The putter head behavior under an impulse situation should not be ignored. If we analyze the situation where the putter head velocity is 10 feet per second and the compression of the golf ball is 0.009 inch, the golf ball-putter head contact time is in the order of 75 microseconds. This appears to be an impulse situation. Hence, the present invention's putter head is small, compact and rigidly connects the heel-toe mass sections to the impact point mass section in order to attain impulse performance. Prior art does not appear to describe or show any concern for the behavior of the putter head impulse performance. If there is any deflection or twisting of the putter head at impact, elongation of the sweet spot may not be realized. Authority states that: "For balls contacted more than ¼ inch from the sweet spot while the other parameters were in perfect order, putts of 8 feet or greater would miss 95 percent of the time."

FIGS. 2A and 2B are sectional views of the mass sections for a putter head of the present invention and a typical prior art heel-toe-sole weighted putter head. Both sectional view are vertical sections taken parallel to the putter face. These section are both taken approximately 0.4 inch rearward of the putter face and are shown as viewed from the back of the putter. Referring to FIG. 2B, the sectional view of a typical prior art putter head, the general outline of the prior art putter head is given by the dashed line 84. The hatched area represents the heel-toe-sole mass sections 80, 81, and 82 of the prior art putter head. It can be seen from the sectional view of FIG. 2B, that putter head twisting, warping, and/or deflection will occur at impact if the golf ball is struck at the vertical midpoint 85 of the putter head. This undersirable behavior of the putter head will occur because of the lack of any rigid connection of the heel-toe mass sections to the midpoint 85 of the putter head. Of course, if the golf ball is struck very near the sole flange, then the impulse performance of the putter head might be improved, but now the golfer is forced to make a major vertical adjustment between the soled position and the proper position at impact. See FIGS. 5A and 5B for an explanation of the above statement.

Referring to FIG. 2A, the sectional view of the present invention's putter head, note that the center of gravity of the heel-toe mass sections 15 and 16, and the impact point mass section center of gravity 28 are located approximately on the horizontal plane 29. Putter head center of gravity 17 is also located approximately on said horizontal plane 29. Since the mass centers 15, 16, 17, and 28 are all located approximately on said horizontal plane 29, the putter head will be free of twisting, warping, or deflection at impact. Not only is it the unique location of the three distinct mass sections 10, 11, and 12, and their mass centers, but it is the method in which they are connected, by high moment of inertia structures 20 and 21, that affords superior impulse performance over prior art putter heads. The putter head-golf ball contact time is in the order of 75 microseconds.

FIG. 3 is a bottom surface view of the putter head. The sole 22 is a thin, approximately 0.06 inch thick, member that wraps around the bottom of the putter head to form a rim for cavities 18 and 19. Towards the heel to toe centerline of the putter head, the sole becomes wider to form a semicircle 23 around said centerline. The radius of said semicircle is approximately 1.65 inches. The widening of the sole at said centerline affords a large surface area for soling of the putter head and the upper surface affords a location for an alignment index (indicia). The high moment of inertia connecting structures 20 and 21, and the heel-toe mass sections 10 and 11 are visible from this view.

FIGS. 4A, 4B, and 4C are sectional views of the putter head. FIG. 4A gives a sectional view of the high moment of inertia connecting structure 21 between the toe mass section and the impact point mass section. The sectional view of structure 21 dramatically shows the high moment of inertia beam action that will work against the golf ball impact force 31. FIG. 3A also gives a view of the cavity 19. FIG. 4B is a sectional view of the heel to toe putter head centerline. This view shows the impact point mass section 12, and the sole 22 at its widest point. The putter head center of gravity 17 to the putter head sole distance, 0.65 inch, is shown as dimension 46. FIG. 4C is a sectional view of the heel mass section 10 at the midsection of said heel mass section.

Figure 5B:
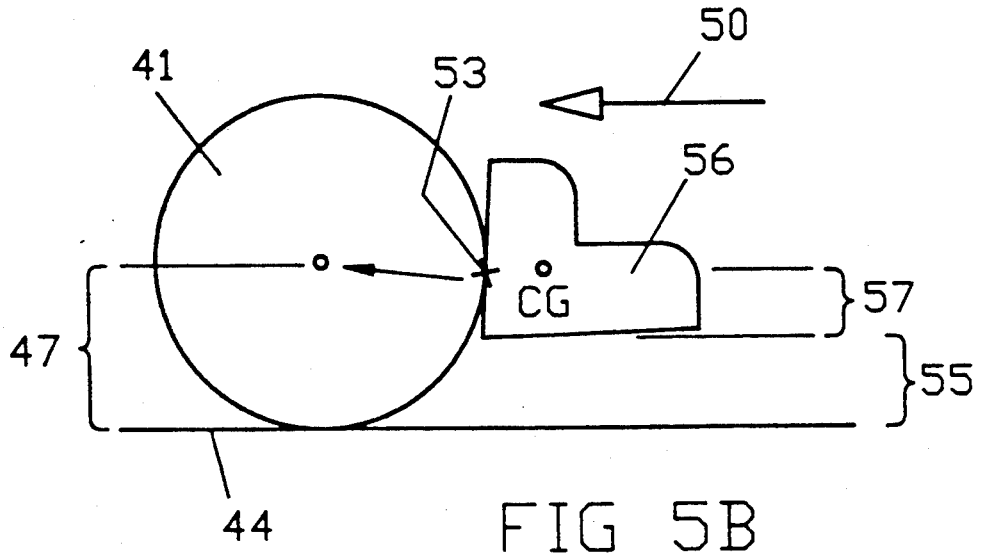
FIG 5B PRIOR ART

FIG. 5A and 5B are diagrams that show a putter head body of the present invention and a prior art putter head body striking a golf ball. FIG. 5A is a diagram of a putter head body 48 of the present invention striking a golf ball 41. The height, 0.65 inch, of the putter head center of gravity relative to the sole is shown by dimension 46. The height, 0.13 inch, of the putter head sole relative to the resting plane of the golf ball is shown as dimension 45. The radius, 0.84 inch, of the golf ball is given by the dimension 47. The line 44 represents the ground, or the resting plane of the golf ball. The horizontal vector 40 represents the direction of the putter head at the moment of impact. The impact point 43 distance to the golf ball resting plane calculates to be 0.78 inch for a putter head face having a loft of 4 degrees. FIG. 5A diagrammatically shows that only a minor (0.13 inch) vertical adjustment 45 of the putter head from the soled address position to the impact position needs to made by the golfer when using a putter of the present invention.

FIG. 5B is a diagram of a prior art putter head body 56 striking a golf ball 41. The impact point 53 distance to the golf ball resting plane is also 0.78 inch in this diagram. The horizontal vector 50 represents the direction of the putter head at the moment of impact. The height, 0.38 inch, of the putter head sole relative to the resting plane of the golf ball is shown as dimension 55. The height of 0.38 inch is derived from an authority's statement that most golfer strike the ball so the impact point is approximately 0.40 inch 57 above the sole of the putter head. The arthmetically derived height of 0.38 inch is 0.78 inch minus 0.40 inch. FIG. 5B diagrammatically shows that a large (0.38 inch) vertical adjustment of the putter head from the soled address position to the impact position is made by most golfer when using prior art putters.

Figure 6:
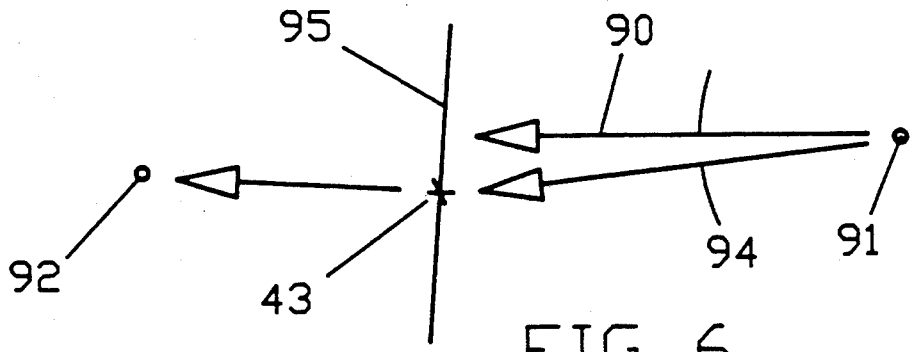
FIG. 6 is a diagram that shows linear momentum forces acting upon the impact point of a putter face.

FIG. 6 is a diagram that shows linear momentum forces acting upon the impact point of a putter face. It has been postulated in prior art Patents that having the putter head center of gravity directly behind the golf ball center of gravity affords maximum momentum transfer to the golf ball. This may be true for the special case when the putter face has zero loft but in all other cases, the above postulate is incorrect. FIG. 6 is a diagram that shows linear momentum forces acting upon the impact point of a putter face having a loft angle of 4 degrees. The horizontal vector 90 represents the linear momentum (mv). The impact point on the putter face 43 is shown by the mark X. The line 95 represents the putter face plane as view from the heel end of the putter head. Since the only point of contact with the golf ball is at the impact point X, momentum transfer to the golf ball is equal to mv multiplied by the cosine of the impact point angle 94. For an angle of 4 degrees (the situation when the putter head center of gravity 91 is directly behind the golf ball center of gravity 92), momentum transfer is equal to 0.9976 mv. For an angle 94 of 0 degree (the situation when the putter head center of gravity is directly behind the impact point), momentum transfer is mv. The difference, mv minus 0.9976 mv may seem small, but nevertheless, the sweet spot has been missed by 0.059 inch. Moreover, with the small shallow horizontal lines produced by the final grinding operation described in U.S. Pat. No. 4,852,879, gear effect back spin will be generated for moderate values of the impact point angle 94. Back spin on a putted ball will generally produce undesirable results.

Figure 7:
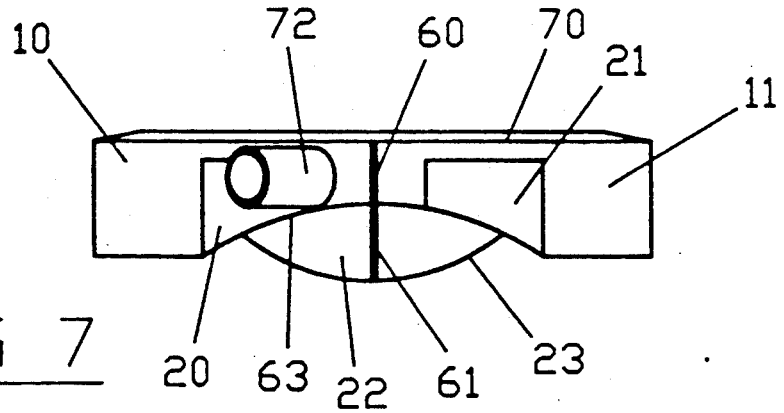
FIG. 7 is a top surface view of the putter head of the present invention.

FIG. 7 is a top surface view of the present invention's putter head. The high moment of inertia connecting structures 20 and 21 as well as the heel-toe mass sections 10 and 11 can be seen from this top surface view. The back side 63 of the high moment of inertia connecting structures 20 and 21 is curved inwardly towards the front surface. Said back side 63 follows a semicircle with a radius of approximately 2.65 inches. The hosel 72 and the low friction highly polished putter face 70 is shown in this top surface view. Alignment aid indicia located on the top surface of putter head 60 and on the top surface of putter sole 61 are shown in this top surface view.

Figure 8:
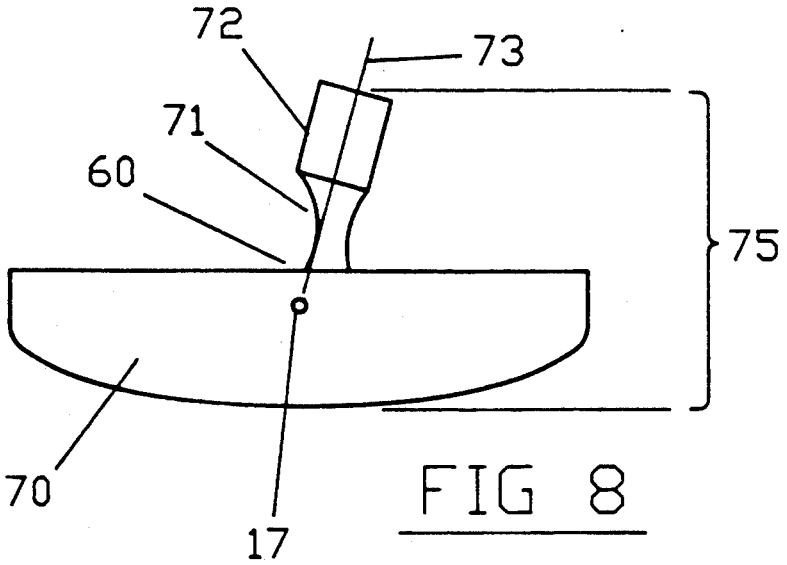
FIG. 8 is a front surface view of the putter head of the present invention.

FIG. 8 is a front surface view of the present invention's putter head. The low friction highly polished putter face 70, the low mass hosel shank 71, and the short hosel 72 are shown in this front surface view. The longitudinal shaft axis 73 and its relationship to the putter head center of gravity 17 is shown in this front surface view. The overall height 75 of the present invention's putter head is approximately 2.25 inches affording a compact design.

Figure 9:
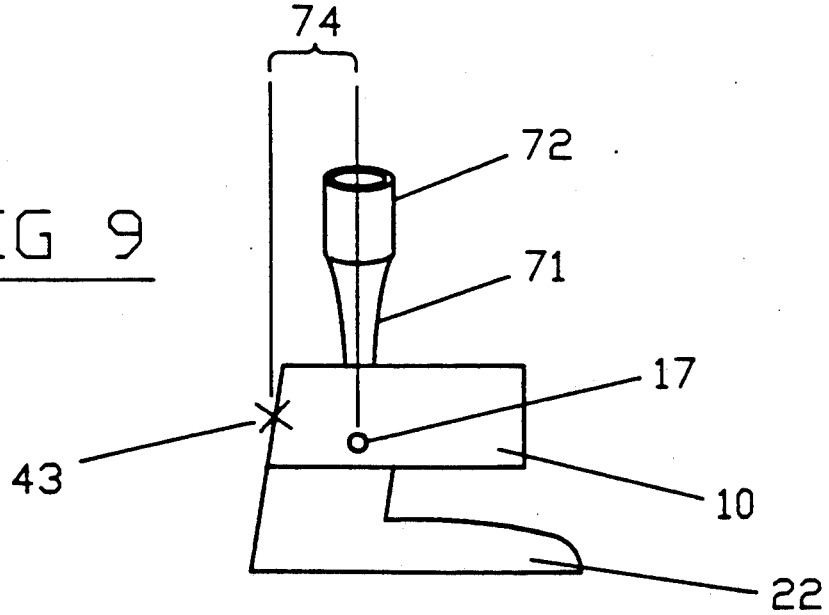
FIG. 9 is a heel end view of the putter head of the present invention.

FIG. 9 is a heel end view of the present invention's putter head. The distance 74 from the putter head center of gravity 17 to the impact point 43 is approximately 0.38 inch for a putter head construction of stainless steel or brass.

Figure 10:
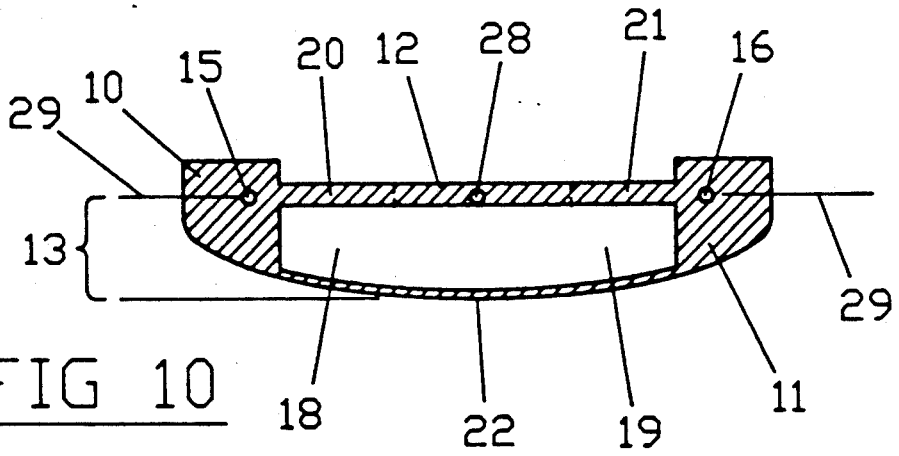
FIG. 10 shows another preferred aspect of the putter head of the present invention.

FIG. 10 shows another preferred aspect of the putter head of the present invention. In this configuration, the impact point mass section 12 is provided as a portion of the high moment of inertia interconnects 20 and 21.

While a preferred embodiment of the present invention has been shown for a particular putter head configuration in the drawings, and described herein, many modifications thereof may be made by a person skilled in the art without departing from the spirit and scope of the present invention. For example, an impact point mass section 12 can be provided as a portion of the high moment of inertia interconnects 20 and 21 between the heel and toe mass sections as illustrated in FIG. 10.

Gravity balanced is defined as the condition where the extension of the putter shaft longitudinal axis intersects the putter head center of gravity. Face balanced is defined as the condition when the putter shaft is supported horizontally with the putter face facing upwards, the sum of the moments about the extension of the longitudinal shaft axis is zero. The impact point mass section is defined as a substantial mass section located directly behind, and in the immediate vicinity of the impact point, and rigidly connected to the heel-toe mass sections. The term hosel is defined to include its connecting means (shank) to the putter head body.

What I claim is:

1. A rigid golf ball putter head;

said putter head having a weight weight being in the range of 230 to 360 grams, being rigidly shaped to define a putter face, a heel, a sole, a toe, a top surface, a hosel, a heel mass section, a toe mass section, an impact point mass section, a first interconnect joining the heel mass section to the impact point mass section, and a second interconnect joining the toe mass section to the impact point mass section;

said putter face being adapted to strike a golf ball;

said putter face having upper and lower edges, toe and heel boundary limits;

said heel being the portion of said putter head that is the closest to the golfer when said golfer has taken a normal putting stance;

said sole being the portion of said putter head which normally rests on the ground when said putter head is held in the playing position, and being a bottom surface of a sole flange;

said toe being the part of said putter head that is the farthest from said heel of said putter head;

said top surface being a surface that connects to the hosel of said putter head;

said hosel being that portion of said putter head that is designed to interface with a shaft;

said hosel being integrally attached to said putter head so that the hosel center line intersects the center of gravity of said putter head;

said heel mass section having a weight of from 12 to 45 percent of said putter head weight, being located near a heel extremity, and being located so that the center of gravity of said heel mass section is on a horizontal plane located from 0.58 to 0.72 inch above the sole;

said toe mass section having a weight of from 14 to 48 percent of said putter head weight, being located near a toe extremity, and being located so that the center of gravity of said toe mass section is on a horizontal plane located from 0.58 to 0.72 inch above the sole;

said impact point mass section having a weight not to exceed 45 percent of said putter head weight, being located substantially half way between the heel and toe extremities, and being located so that the center of gravity of said impact point mass section is on a horizontal plane located from 0.58 to 0.72 inch above the sole;

said first interconnect rigidly connecting said heel mass section to said impact point mass section, traversing along a horizontal plane located from 0.58 to 0.72 inch above the sole and having a rearward dimension measured from the putter face along said horizontal plane of at least 0.4 inch affording a high moment of inertia interconnect;

said second interconnect rigidly connecting said toe mass section to said impact point mass section, traversing along a horizontal plane located from 0.58 to 0.72 inch above the sole and having a rearward dimension measured from the putter face along said horizontal plane of at least 0.4 inch affording a high moment of inertia interconnect;

said center of gravity of said putter head located substantially halfway between the heel and toe, and on a horizontal plane located from 0.58 to 0.72 inch above the sole, and located within the impact point mass section.

2. The putter head of claim 1, wherein said putter head is face balanced.

3. The putter head of claim 1, wherein said putter face is milled flat within less than 0.003 inch of variation across said putter face, and wherein said putter face has a polished surface affording a substantially frictionless said putter face.

4. The putter head of claim 1, wherein the sole flange has an upper surface, and said upper surface and said top surface of the putter head have alignment aid indicia located to represent the center of gravity of said putter head, wherein said indicia are clearly visible from a position directly above the center of gravity of said putter head.

5. The putter head of claim 1, wherein said putter head is being constructed of aluminum or other material having substantially the same density.

6. The putter head of claim 1, wherein said putter head is being constructed of aluminum or other material having substantially the same density, and wherein said putter head is face balanced.

7. The putter head of claim 1, wherein said putter head is being constructed of aluminum or other material having substantially the same density, and wherein said putter face is milled flat to within less than 0.003 inch of variation across said putter face, and wherein said putter face has a polished surface affording a substantially frictionless said putter face.

8. The putter head of claim 1, wherein said putter head is constructed of aluminum or other material having substantially the same density, wherein the sole flange has an upper surface, and said upper surface and said top surface of the putter head have alignment aid indicia located to represent the center of gravity of said putter head, wherein said indicia are clearly visible from a position directly above the center of gravity of said putter head.

9. A golf ball putter comprising a rigid putter head a shaft and a grip;

said putter head having a weight being in the range of 230 to 360 grams, being rigidly shaped to define a putter face, a heel, a sole, a toe, a top surface, a hosel, a heel mass section, a toe mass section, an impact point mass section, a first interconnect joining the heel mass section to the impact point mass section, and a second interconnect joining the toe mass section to the impact point mass section;

said putter face being adapted to strike a golf ball;

said putter face having upper and lower edges, toe and heel boundary limits;

said heel being the portion of said putter head that is the closest to the golfer when said golfer has taken a normal putting stance;

said sole being the portion of said putter head which normally rests on the ground when said putter head is held in the playing position, and being a bottom surface of a sole flange;

said toe being the part of said putter head that is the farthest from said heel of said putter head;

said top surface being the surface that connects to the hosel of said putter head;

said hosel being that portion of said putter head that is designed to interface with a shaft;

said hosel being integrally attached to said putter head so that the hosel center line intersects the center of gravity of said putter head;

said heel mass section having a weight of from 12 to 45 percent of said putter head weight, being located near a heel extremity, and being located so that the center of gravity of said heel mass section is on a horizontal plane located from 0.58 to 0.72 inch above the sole;

said toe mass section having a weight of from 14 to 48 percent of said putter head weight, being located near a toe extremity, and being located so that the center of gravity of said toe mass section is on a horizontal plane located from 0.58 to 0.72 inch above the sole;

said impact point mass section having a weight not to exceed 45 percent of said putter head weight, being located substantially half way between the heel and toe extremities, and being located so that the center of gravity of said impact point mass section is on a horizontal plane located from 0.58 to 0.72 inch above the sole;

said first interconnect rigidly connecting said heel mass section to said impact point mass section, traversing along a horizontal plane located from 0.58 to 0.72 inch above the sole and having a rearward dimension measured from the putter face along said horizontal plane of at least 0.4 inch affording a high moment of inertia interconnect;

said second interconnect rigidly connecting said toe mass section to said impact point mass section, traversing along a horizontal plane located from 0.58 to 0.72 inch above the sole and having a rearward dimension measured from the putter face along said horizontal plane of at least 0.4 inch affording a high moment of inertia interconnect;

said center of gravity of said putter head located substantially halfway between the heel and toe, and on a horizontal plane located from 0.58 to 0.72 inch above the sole, and located within the impact point mass section.

10. The putter of claim 9, wherein said putter head is face balanced.

11. The putter of claim 9, wherein said putter face is milled flat within less than 0.003 inch of variation across said putter face, and wherein said putter face has a polished surface affording a substantially frictionless said putter face.

12. The putter of claim 9, wherein the sole flange has an upper surface, and said upper surface and said top surface of the putter head have alignment aid indicia located to represent the center of gravity of said putter head, wherein said indicia are clearly visible from a position directly above the center of gravity of said putter head.

13. The putter of claim 9, wherein said putter head is constructed of aluminum or other material having substantially the same density.

14. The putter of claim 9, wherein said putter head is constructed of aluminum or other material having substantially the same density, and wherein said putter head is face balanced.

15. The putter of claim 9, wherein said putter head is constructed of aluminum or other material having substantially the same density, and wherein said putter face is milled flat to within less than 0.003 inch of variation across said putter face, and wherein said putter face has a polished surface affording a substantially frictionless said putter face.

16. The putter of claim 9, wherein said putter head is constructed of aluminum or other material having substantially the same density, wherein the sole flange has an upper surface, and said upper surface and said top surface of the putter head have alignment aid indicia located to represent the center of gravity of said putter head, wherein said indicia are clearly visible from a position directly above the center of gravity of said putter head.

* * * * *